US006759614B2

(12) United States Patent
Yoneyama

(10) Patent No.: US 6,759,614 B2
(45) Date of Patent: Jul. 6, 2004

(54) KEYBOARD SWITCH

(75) Inventor: Masayuki Yoneyama, Kitasaku-Gun (JP)

(73) Assignee: Minebea Co., Ltd., Nagano-Ken (JP)

( * ) Notice: Subject to any disclaimer, the term of this patent is extended or adjusted under 35 U.S.C. 154(b) by 0 days.

(21) Appl. No.: 10/374,337

(22) Filed: Feb. 26, 2003

(65) Prior Publication Data

US 2003/0178293 A1 Sep. 25, 2003

(30) Foreign Application Priority Data

Feb. 27, 2002 (JP) ..... 2002-052214

(51) Int. Cl.[7] ..... H01H 13/70
(52) U.S. Cl. ..... 200/344
(58) Field of Search ..... 200/5 A, 517, 200/344, 345; 400/490, 491, 491.2, 495, 495.1, 496

(56) References Cited

U.S. PATENT DOCUMENTS

| | | | | |
|---|---|---|---|---|
| 4,433,225 A | | 2/1984 | Cowles | 200/340 |
| 5,625,532 A | * | 4/1997 | Sellers | 200/344 |
| 5,847,337 A | * | 12/1998 | Chen | 200/5 A |
| 5,964,341 A | * | 10/1999 | Tsai | 200/344 |
| 6,011,227 A | * | 1/2000 | Yoneyama | 200/344 |
| 6,020,565 A | * | 2/2000 | Pan | 200/344 |
| 6,174,097 B1 | | 1/2001 | Daniel | 400/495 |
| 6,183,150 B1 | | 2/2001 | Kao | 400/47.2 |
| 6,483,050 B1 | * | 11/2002 | Narusawa et al. | 200/5 A |
| 6,597,344 B1 | * | 7/2003 | Narusawa et al. | 200/344 |

FOREIGN PATENT DOCUMENTS

JP HEI6/1994-36647 7/1992

* cited by examiner

*Primary Examiner*—Michael A. Friedhofer
(74) *Attorney, Agent, or Firm*—Schulte Roth & Zabel LLP; Joel E. Lutzker

(57) ABSTRACT

The present invention provides a keyboard switch structure that allows the height of a keyboard switch to be sufficiently minimized so as to be suitable for notebook personal computers or other portable devices. The present invention also provides a keyboard switch assembly that allows the keytop attached to the keyboard switch to be removed and replaced in a simple manner without destroying or damaging the keyboard switch. The keyboard switch is configured in a pantograph structure having cross arms that intersect each other to form an X-like structure. The upper portion of the pantograph structure is movably attached to a coupling plate on the underside of the keytop and the lower portion of the structure is movably attached to a base plate so as provide the keytop with movement in the vertical direction. The keyboard switch has two frame members that each have two cross arms that are parallel and fixed relative to each other. The first and second frame members intersect and engage each other so as to allow at least partial rotational movement about an intersection point lower than the center of each cross arm and in such a manner as to minimize the height of the keyboard switch.

23 Claims, 6 Drawing Sheets

[Fig. 1]
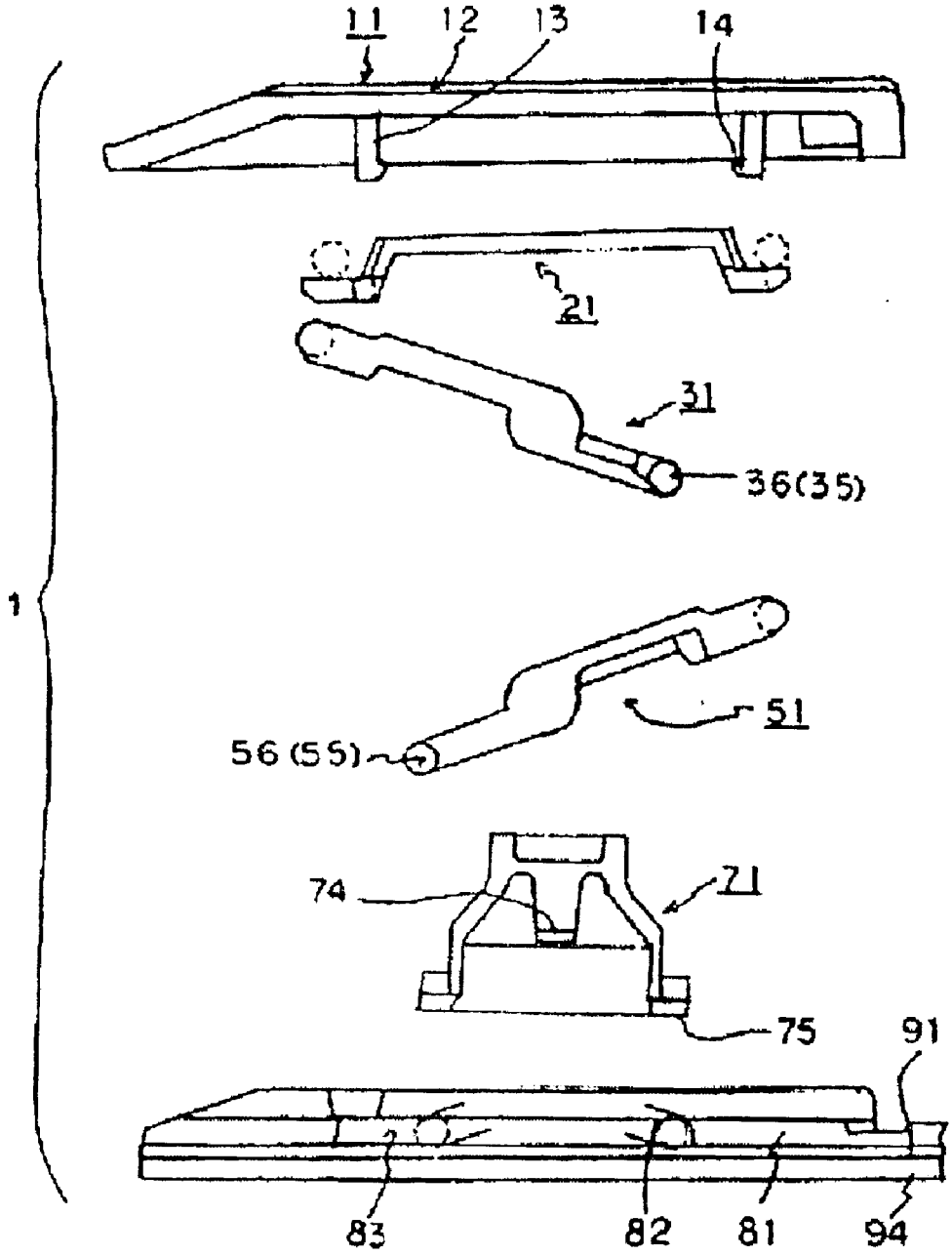

[Fig. 2]
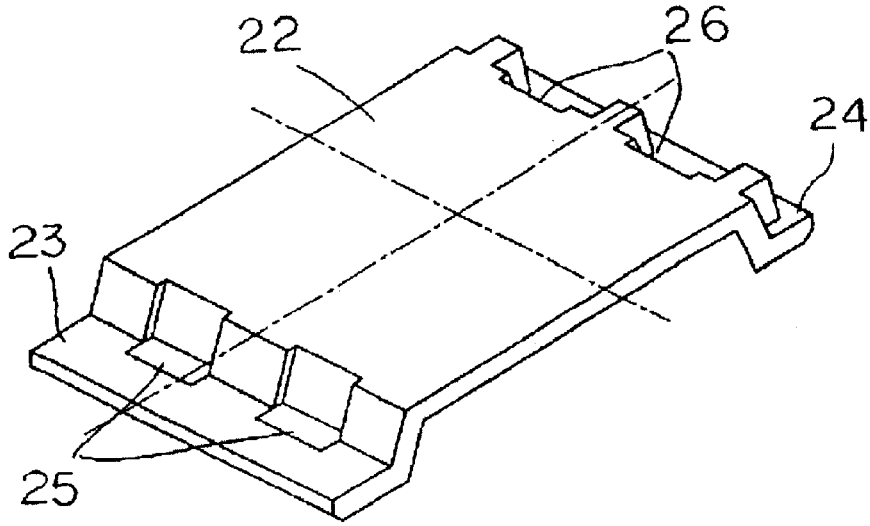
[Fig. 3]
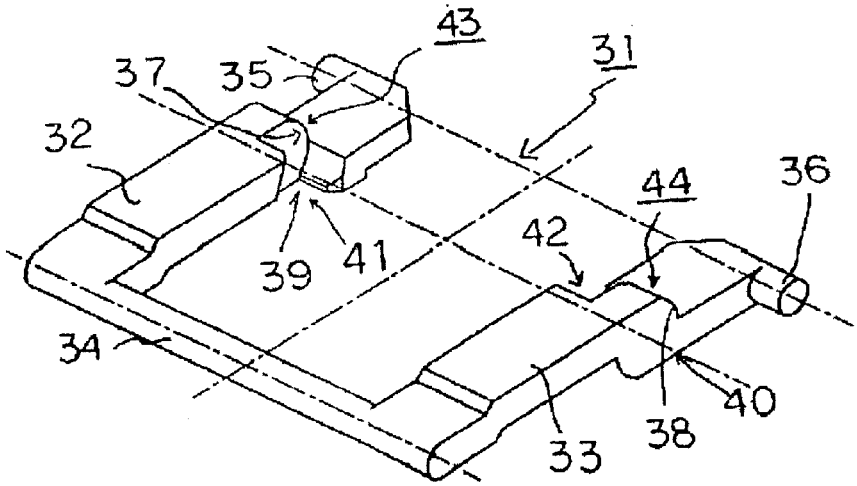

[Fig. 4]
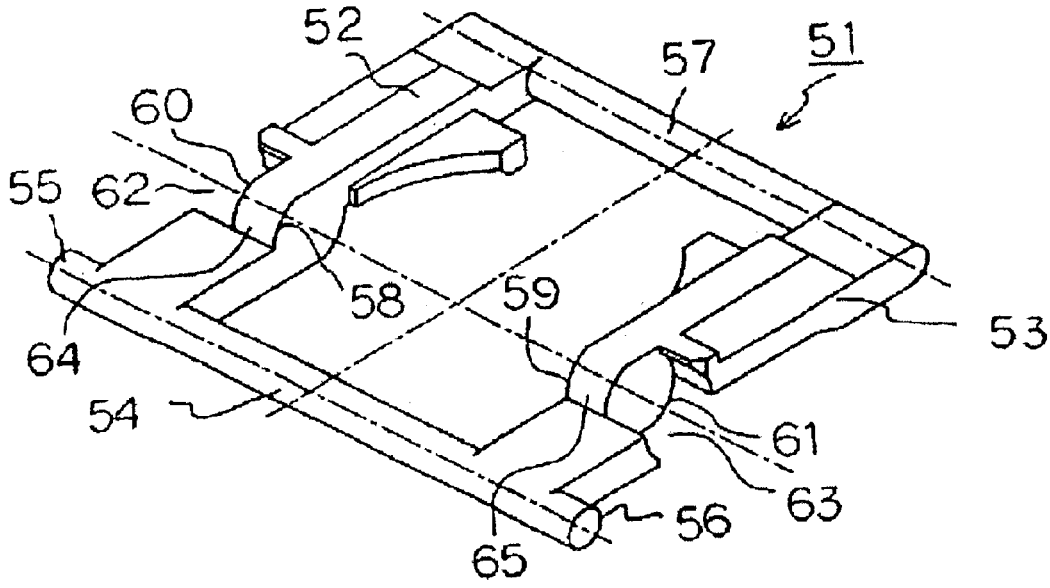

[Fig. 5]
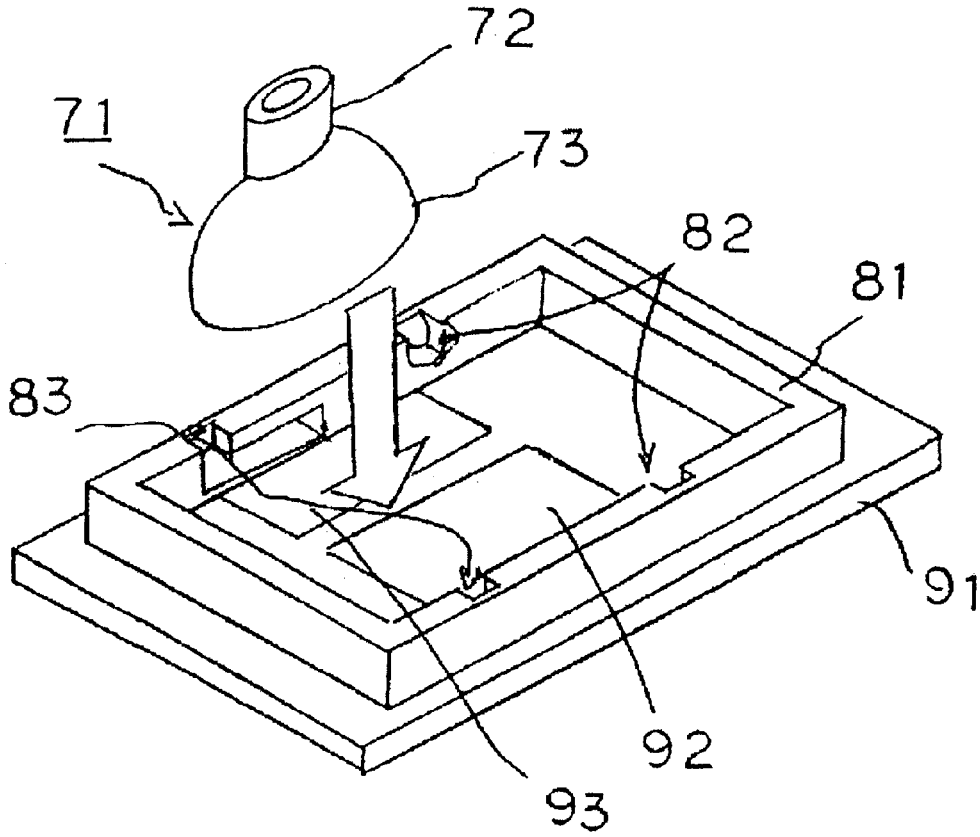

[Fig. 6]
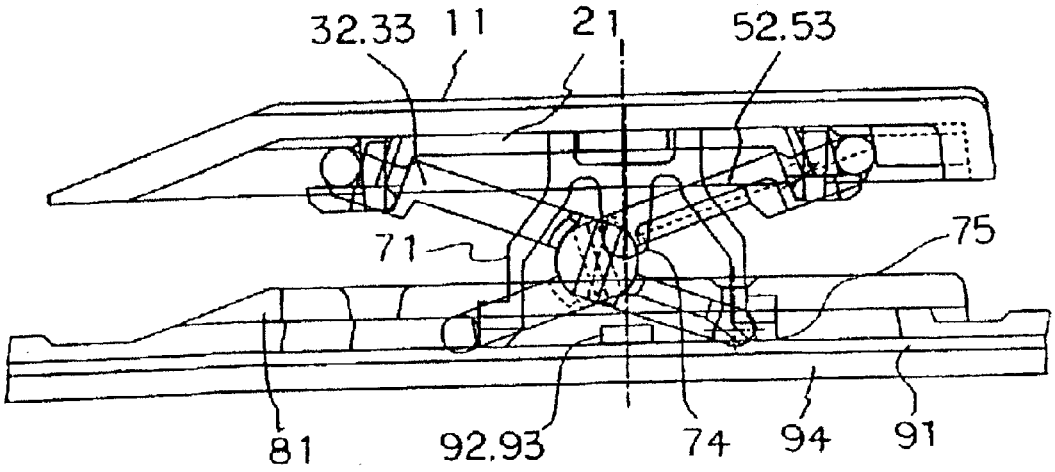

[Fig. 7]
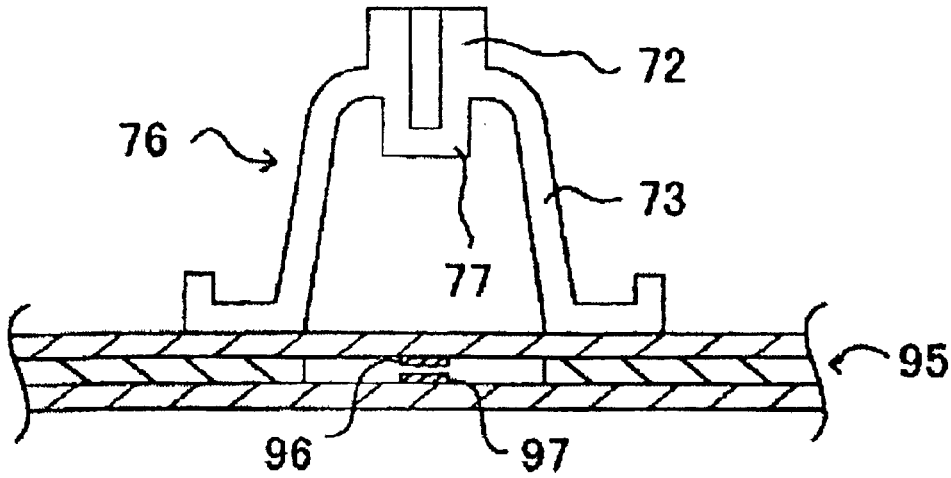

KEYBOARD SWITCH

BACKGROUND OF THE INVENTION

This application claims priority from Japanese Patent Application No. 2002-052214, filed Feb. 27, 2002.

FIELD OF THE INVENTION

The present invention relates to an apparatus and method of assembly for a personal computer keyboard switch. More particularly, the present invention pertains to a keyboard switch that can be used in thin notebook type personal computers.

DESCRIPTION OF THE PRIOR ART

With the advent of desktop computers, the keyboard switch has been widely used as a data input device, and because of technological advances in computer technology such use has significantly increased over the years. Advances in technology are responsible for the significant miniaturization of notebook computers and other portable data devices that has taken place over the last few years. The height of some notebook computers is less than two centimeters. To accommodate the reduction in height of notebook computers, the structure of the keyboard switch has also necessarily evolved. Developments in keyboard switch technology include the use of a film-membrane structure that contains a plurality of keyboard switches. The keyboard switches are configured in the form of thin structures called pantographs and are positioned on the film-membrane.

An example of such a keyboard switch is disclosed and described in Japanese Laid Open Patent Publication No. Hei 6/1994-36647. Publication No. Hei 6/1994-36647 discloses a pantograph type keyboard switch structure that has a first intersecting member which is formed by allowing an extending section to extend in one direction. The extending section extends from the upper side of a rotation support section with it as the center and two link members each of which have arms that extends parallel to the extending section in the other direction from the lower side thereof so as to intersect each other at an intersecting point at the upper side from the center of the mutual arms in a rotatable manner. A second intersecting member having the same structure as the first intersecting member is arranged and placed a certain distance from the first intersecting member, thereby forming a pantograph shaped member, the tip section of the link member positioned at the one side with the intersecting point of the intersecting members as a center is allowed to be supported by a shaft on a holder plate arranged on a flexible circuit board and at the underside of a keytop in a freely rotatable manner, and at the same time the tip section of the link member positioned at the opposite side is allowed to be supported with respect to the holder plate and the underside of a keytop in a freely rotatable manner and in a freely slidable and movable manner, in such a manner that when the key top is pressed down, a switching member may be actuated by an attaching rod of the pantograph shaped member and at the same time the extending sections of the folded pantograph shaped member may be kept in parallel.

In conventional keyboard switches, such as the example given above, a rod attached to the pantograph shaped keyboard switch makes contact with an elastic tactile rubber cap when the keytop is pressed, thereby actuating the keyboard switch. This configuration may not allow the height of the pantograph structure to be reduced sufficiently to accommodate the reduced height requirements present in notebook computers. In addition, in conventional keyboard switches the keytop is directly attached to the upper ends of the pantograph keyboard switch structure, thereby making the pantograph structure and keytop inseparable. As a result, when removal and/or replacement of a keytop are desired, the pantograph structure must also be removed and replaced or disassembled.

SUMMARY

In general the first aspect of the present invention features a keyboard switch that includes a pantograph structure. The pantograph structure has a first frame member and a second frame member. The first frame member has two cross arms fixed and parallel relative to each other and the second frame member has two cross arms fixed and parallel relative to each other. The first frame member and the second frame member engagedly intersect at an intersection point located below the center of the cross arms of each frame member forming an roughly X-like structure so as to allow free rotational movement of the first frame member and the second frame member about the intersection point to provide vertical movement for a keytop.

The keyboard switch also includes a coupling plate coupled to the underside of the keytop, a base plate, wherein the base plate is pivotally coupled to the lower ends of the cross arms of the first frame member by protrusions that extend from the cross arms so as to allow at least partial rotational movement. The base plate is also pivotally coupled to the lower ends the cross arms of said second frame member so as to allow at least partial sliding movement which may be in the direction roughly perpendicular to the direction of movement of the keytop. The upper ends of the first frame member and the second frame are moveably coupled to the coupling plate, wherein the coupling plate is also coupled to the underside of keytop so as to allow the keytop to be removed from or attached to the coupling plate. The switch further includes an elastic cap, wherein the elastic tactile cap is positioned between the coupling plate and the base plate.

An embodiment of the present invention may include the keyboard switch mentioned above, wherein the intersection point is one-third from the bottom of the cross arms of the first and second frame members.

Another embodiment of the present invention may include the keyboard switch mention above, wherein the first frame member has a first shaft receiving section that includes a shaft receiving groove and a shaft receiving plate having an arc section so that the shaft receiving plate is adjacent to the shaft receiving groove at the inner side of each cross arm. The second frame member may have a second receiving section that includes a shaft receiving groove and a shaft receiving plate having an arc section adjacent to each other at the outer side of each cross arm. The shaft receiving plate of second shaft receiving section engages into the shaft receiving groove of the first receiving shaft second and may allow free rotational movement and at the same time, the shaft receiving plate of first shaft receiving section engages into the shaft receiving groove of said second receiving shaft second an may also allow at least partial rotational movement.

BRIEF DESCRIPTION OF THE DRAWINGS

FIG. 1 is an exploded front view of a keyboard switch in accordance with a preferred embodiment of the present invention in a disassembled form.

FIG. 2 shows a coupling plate of the keyboard switch in accordance with a preferred embodiment of the present invention.

FIG. 3 shows a first frame member of the keyboard switch in accordance with a preferred embodiment of the present invention.

FIG. 4 shows a second frame member of the keyboard switch in accordance with a preferred embodiment of the present invention.

FIG. 5 shows a positional relationship between an elastic cap and a hinge frame and a film-like or flexible membrane circuit board in a preferred embodiment of the present invention.

FIG. 6 is a front view of a keyboard switch in accordance with a preferred embodiment of the present invention.

FIG. 7 is a cross sectional view showing the positional relation between the plastic cap and the membrane sheet in accordance with a preferred embodiment of the present invention.

DETAILED DESCRIPTION

Referring to the drawings, we will describe a preferred embodiment of the present invention. FIG. 1 is an exploded side view of a keyboard switch configured in accordance with a preferred embodiment of the present invention. As shown in FIG. 1, keyboard switch 1 includes keytop 11 having coupling protrusions 13 and 14 that extend from the underside of keytop 11 so as to allow keytop 11 to be coupledd with coupling plate 21. Coupling plate 21 may be made of a thin synthetic resin sheet. Keyboard switch 1 also includes a first frame member 31, a second frame member, elastic cap 71, hinge frame 81, circuit board 91, and base plate 94. Circuit baord 91 may be made of a film-like member or some other suitable material. First frame member 21 includes protrusions 35 and 36 that extend perpendicularly from frame member 21. Second frame member 51 includes protrusions 55 and 56 that extend perpendicularly from second frame member 51. Hinge frame 81 includes a first cross arm receiving section 82 and a second cross arm receiving section, wherein the first receiving section may be a bearing hole and the second receiving section may be a slide groove 83. Elastic cap 71, which may be made of a synthetic material such as rubber or some other suitable material, includes moveable contact point 74 and lower edge section 75. Typically, letters, numbers or other characters are inscribed or otherwise placed on topside 12 of keytop 11.

Referring to FIG. 2, coupling plate 21 (shown in FIG. 1) includes flat plate section 22. Flat plate section 22 makes contact with and presses upon elastic tactile cap 71 when keytop 11 is pressed. Step sections 23 and 24 are formed in the front and rear sections of flat plate section 22. Flat plate 22 includes coupling holes 25 and 26 that allow coupling protrusions 13 and 14 that extend from the underside keytop 11 to pass through flat plate 22. Coupling holes 25 and 26 are located in close proximity of step sections 23 and 24, respectively. First frame member 31 and second frame member 51 are coupled to step sections 23 and 24, respectively, of flat plate 22.

Referring to FIG. 3, first frame member 31 may be made of a synthetic resin material or some other suitable material. First frame member 31 has two symmetric and parallel cross arms 32 and 33. One end of cross arm 32 and one end of cross arm 33 is connected by connecting rod 34. On the opposite ends of cross arms 32 and 33, protrusions 35 and 36 extend outwardly from perpendicular to cross arms 32 and 33, respectively. Shaft receiving plates 39 and 40 having arc sections 37 and 38, respectively, may be positioned approximately two-thirds the total length of cross arms 32 and 33 when using connecting rod 34 as a reference point. Shaft receiving grooves 41 and 42 are located adjacent to shaft receiving plates 39 and 40, respectively, along the inner side cross arms 32 and 33. Shaft receiving plates 39 and 40 and corresponding shaft receiving grooves 41 and 42 form first shaft receiving sections 43 and 44, respectively. Although cross arms 32 and 33 extend parallel to each other, they are positioned on different levels between the connecting rod 34 side and protrusions 35 and 36 sides with the first shaft receiving sections 39 and 40 as the center.

Referring to FIG. 4, second frame member 51 may be made of a synthetic resin material. Second frame member 51 has two symmetric and parallel cross arms 52 and 53. Cross arms 52 and 53 are connected by a connecting rod 54. Protrusions 55 and 56 extend outwardly from and perpendicular to cross arms 52 and 53. At the other end of second frame member 51, cross arms 52 and 53 are further connected by connecting rod 57. Shaft receiving plates 60 and 61 having arc sections 58 and 59, respectively, may be positioned approximately one-third the total length of cross arms 52 and 53 when using connecting rod 54 as a reference point. Shaft receiving grooves 62 and 63 are located adjacent to receiving shaft plates 60 and 61, respectively, along the outer side of cross arms 52 and 53. Shaft receiving plates 60 and 61 and corresponding shaft receiving grooves 62 and 63 form second receiving sections 64 and 65, respectively. Although cross arms 52 and 53 extend parallel to each other, they are positioned on different levels between connecting rod 54 side and connecting rod 57 with the second shaft receiving sections 64 and 65 as the center.

Referring to FIG. 5, elastic tactile cap 71 is shaped like a hollow cup. Elastic tactile cap 71 includes pressing section 72 at the top of cap 71, elastic section 73 that forms the cup portion of cap 71 and movable contact point 74, shown in FIG. 1, is located inside cap 71. As pressing section 72 is pressed down upon by keytop 11 elastic section 73 is likewise depressed down. Such pressing action produces a familiar clicking noise and accompanying sensation. FIG. 5, also shows circuit board 91, which may be a flexible membrane or film-like type circuit board. Circuit board 91 is mounted on base plate 94 (shown in FIGS. 1 and 7) and includes at least two fixed contact points, 92 and 93. Depressing pressing section 72 causes movable contact point 74 to make contact with fixed contact points 92 and 93 on circuit board 91. Such contact results in electrical conductivity at fixed contact points 92 and 93.

The following is a detailed description of assembly and operation of the keyboard switch in accordance with a preferred embodiment of the present invention. First, hinge frame 81 may be attached to circuit board 91 by pinching with an appropriate means where for example, a protrusion extending from base plate 94 under circuit board 91 is inserted into receiving slot on hinge frame 81 causing hinge frame 81 to be coupled to base plate 94. Lower edge section 75 of elastic cap 71 is thinly coated with an adhesive, and then adhered onto fixed contact points 92 and 93 of circuit board 91. Shaft receiving plates 60 and 61 of second shaft receiving sections 64 and 65, respectively, are rotatably fitted into shaft receiving grooves 41 and 42 of first shaft receiving sections 43 and 44, respectively, of the cross arms 32 and 33. Concurrently shaft receiving plates 39 and 40 of first shaft receiving sections 43 and 44, respectively, are also rotatably fitted into shaft receiving grooves 62 and 63 of second shaft receiving sections 64 and 65, respectively of the cross arms 52 and 53. As a result cross arms 32 and 33 and cross arms 52 and 53 are allowed to engagedly intersect each other in at least a partially rotatable manner, thereby forming a roughly X-shaped pantograph structure.

Next, protrusions 35 and 36 provided respectively at the lower ends of cross arms 32 and 33 are fitted into a bearing hole 82, which may be provided on the surface of hinge frame 81 so that cross arms 32 and 33 may move in at least a partially rotatable manner. Similarly, protrusions 55 and 56 provided respectively at the lower ends of cross arms 52 and 53 are fitted into slide groove 83 provided on the surface of hinge frame 81 so that cross arms 52 and 53 may slide and move in at least a partially rotatable manner. During assembly, connecting rod 57 that connects cross arms 52 and 53 is positioned and mounted on step section 24 of coupling plate 21. Similarly, connecting rod 34 that connects cross arms 32 and 33 is positioned and mounted on step section 23 of coupling plate 21. Next, keytop 11 is placed on coupling plate 21 so that coupling protrusions 13 and 14 extending from the underside of keytop 11 are fitted through the coupling holes 25 and 26 of coupling plate 21 so as to attach keytop 11 to coupling plate 11, thereby completing the method of keyboard switch assembly in accordance with the present invention. It should be understood that the steps of the method of keyboard switch assembly do not necessarily have to be performed in the order described above.

FIG. 6 is a cross sectional view of an assembled keyboard switch in accordance with a preferred embodiment of the present invention. As FIG. 6 illustrates, when the keyboard switch is fully assembled elastic rubber cap 71 is in a fully extended position so as to place the switch in an OFF state. When keytop 11 is pressed, while the keyboard switch in its normally OFF state, the pantograph structure, which includes cross arms 32, 33, 52, and 53, is likewise depressed or made to collapse. More specifically, when keytop 11 is pressed it causes coupling plate 21 attached to the underside of keytop 11 in turn to press down on elastic cap 71. When elastic cap 71 is so depressed it produces a familiar clicking noise and/or accompanying sensation. Depressing elastic cap 71 causes movable contact point 74 located within elastic cap 71 to make contact with fixed contact points 92 and 93. Contact between movable contact point 74 and fixed contact points 92 and 93 causes the keyboard switch to be set to the ON state. At this time, since cross arms 32, 33, 52 and 53 are structured on different levels, cross arms 32 overlaps the cross arm 52 and cross arm 33 overlap cross arm 53 completely in the vertical direction. When keytop 11 is no longer being depressed, keytop 11 is restored to its normal position by the restorative force produced in the rubber or other synthetic material of elastic cap 71.

FIG. 7 illustrates another embodiment of the present invention. FIG. 7 shows elastic tactile cap 76 in its extended normal position that corresponds to the keyboard switch being set to the OFF state. In contrast to the embodiment described above where film-like circuit board 91 includes at least two fixed contact points, 92 and 93. The embodiment described in FIG. 7 illustrates that film-like circuit board 91 may be substituted with three-ply circuit membrane 95, wherein three-ply membrane 95 includes at least two contact points, movable contact point 96 and fixed contact point 97. Elastic tactile cap 76 includes movable protrusion 77 inside its elastic section 73 and pressing section 72 is positioned at the top of cap 76. When elastic tactile cap 76 is pressed in the downward direction movable protrusion 77 presses a synthetic resin plate which holds movable contact point 96, thereby allowing movable contact point 96 to make contact with fixed contact point 97. When movable contact point 96 and fixed contact point 97 makes contact, electrical conductivity results setting the keyboard switch to the ON state. Conversely, in the case where elastic tactile cap 76 is no longer depressed movable switch 96 is restored to a non-contact position by the restoring force of the synthetic resin plate that holds movable contact point 96. When movable contact point 96 and fixed contact point 97 are in a non-contact position the keyboard switch is set to the OFF state.

As explained in detail above, the keyboard switch in accordance with one aspect of the present invention includes a first frame member having two parallel cross arms that are fixed relative to each other. A second frame member also has two parallel cross arms that are similarly fixed. Because the intersection point of first frame member and second frame member may be located at a point below the center of each of the cross arms, which allow the cross arms to be engaged with each other in a freely rotatable manner, it is possible to construct a pantograph structure having a reduced height that will make it suitable for use in notebook or other thinly dimensioned computers or portable data devices.

In accordance with another aspect of the present invention, because there is no rod suspended from the two frames that attach the cross arms of the pantograph structure as is found in conventional switches, the pantograph structure here may provide sufficient space to accommodate a conventional size elastic tactile rubber cap such as those used in conventional keyboard switches thereby providing the same tactile feel or sensation as is produced in conventional switches.

In accordance with another aspect of the present invention, keytop 11 is coupled to coupling plate 21 so as to allow keytop 11 to be attached to or removed from the keyboard switch in a manner that eliminates the need to remove or disassemble the underlying pantograph structure.

In the foregoing description, the apparatus and method of the present invention have been described with reference to specific examples. It is to be understood and expected that variations in the principles of the apparatus and method herein disclosed may be made by one skilled in the art and it is intended that such modifications, changes, and substitutions are to be included within the scope of the present invention as set forth in the appended claims. The specification and drawings are accordingly to be regarded in an illustrative rather than restrictive sense.

What is claimed is:

1. A keyboard switch comprising:

a first frame member having a first pair of cross arms, wherein said first pair of cross arms has a first pair of receiving grooves and a first pair of receiving plates;

a second frame member having a second pair of cross arms, wherein said second pair of cross arms has a second pair of receiving grooves and a second pair of receiving plates;

wherein said first frame member and said second frame member are configured to form a pantograph structure, wherein said first frame member and said second frame member engagedly intersect at an intersection point to allow at least partial rotational movement of said first frame member and said second frame member about said intersection point;

a coupling plate coupled to a keytop, wherein upper ends of said first frame member and upper ends of said second frame member are moveably coupled to said coupling plate;

a hinge frame, wherein lower ends of said first pair of cross arms are pivotally coupled to said hinge frame, wherein lower ends of said second pair of cross arms pivotally and slidably coupled to said hinge frame, a base plate; and an elastic cap, wherein said elastic cap is positioned between said coupling plate and said base plate.

2. The keyboard switch of claim 1, wherein the lower ends of said first pair of cross arms are pivotally coupled by protrusions that extend from said first pair of cross arms to said hinge frame.

3. The keyboard switch of claim 1, wherein the lower ends of said second pair of cross arms are pivotally and slidably coupled by protrusions that extend from said second pair of cross arms to said hinge frame.

4. The keyboard switch of claim 1, wherein said first pair of cross arms are fixed and parallel relative to each other.

5. The keyboard switch of claim 1, wherein said second pair of cross arms are fixed and parallel relative to each other.

6. The keyboard switch of claim 1, wherein said intersection point is substantially twice as far from the upper ends of said first pair of cross arms as from the lower ends of said first pair of cross arms, and is substantially twice as far from the upper ends of said second pair of cross arms as from the lower ends of said second pair of cross arms.

7. The keyboard switch of claim 1, wherein said second receiving plate engages into said first receiving groove at the intersection point said first receiving plate engages into said second receiving groove at the intersection point so as to allow at least partial rotational movement.

8. The keyboard switch of claim 1, wherein said hinge frame includes a first cross arm receiving section that receives said first pair of cross arms.

9. The keyboard switch of claim 8, wherein said first cross arm receiving section receives protrusions that extend from said first pair of cross arms.

10. The keyboard switch of claim 9, wherein said first cross arm receiving section is a bearing hole.

11. The keyboard switch of claim 1, wherein said hinge frame includes a second cross arm receiving section that receives said second pair of cross arms.

12. The keyboard switch of claim 11, wherein said second cross arm receiving section receives protrusions that extend from said second pair of cross arms.

13. The keyboard switch of claim 12, wherein said second cross arm receiving section is a slide groove.

14. The keyboard switch of claim 1, wherein said first and second frame members are made of synthetic resin material.

15. The keyboard switch of claim 1, wherein said elastic cap is made of rubber.

16. The keyboard switch of claim 1, wherein said coupling plate is made of synthetic resin material.

17. The keyboard switch of claim 1, wherein further including a circuit board that includes at least two contact points.

18. The keyboard switch of claim 17, wherein said circuit board includes at least two contact points and at least two of said contact points are fixed.

19. The keyboard switch of claim 17, wherein said circuit board includes at least two contact points and at least one of said contact points is fixed and another is moveable.

20. The keyboard switch of claim 17, wherein said circuit board is made of a film-like material.

21. The keyboard switch of claim 17, wherein said circuit board is a three-ply circuit member.

22. The keyboard switch of claim 17, wherein said circuit board is a flexible membrane.

23. The keyboard switch of claim 1, wherein said coupling plate is coupled to said keytop by coupling protrusions that extend from said keytop and through coupling holes in said coupling plate.

* * * * *